US005777951A

United States Patent [19]

Mitschele et al.

[11] Patent Number: 5,777,951

[45] Date of Patent: Jul. 7, 1998

[54] PARKING METER

[75] Inventors: Frederick L. Mitschele, New Westminster; Damien E. Reynolds, Vancouver, both of Canada

[73] Assignee: Digital Pioneer Technologies Corp., Vancouver, Canada

[21] Appl. No.: 588,941

[22] Filed: Jan. 19, 1996

[51] Int. Cl.[6] ..... G07C 1/30

[52] U.S. Cl. ..... 368/90

[58] Field of Search ..... 368/90–92, 10

[56] References Cited

U.S. PATENT DOCUMENTS

| | | | |
|---|---|---|---|
| 4,379,334 | 4/1983 | Feagins, Jr. et al. | 368/90 |
| 4,823,928 | 4/1989 | Speas | 194/217 |
| 4,967,895 | 11/1990 | Speas | 194/200 |
| 5,442,348 | 8/1995 | Mushell | 340/932.2 |

*Primary Examiner*—Bernard Roskoski

*Attorney, Agent, or Firm*—Oyen Wiggs Green & Mutala

[57] ABSTRACT

A parking meter includes a microcontroller and a timer coupled with the microcontroller. A mechanism for accepting payment by coin, credit card or both is coupled with the microcontroller for accepting payment for use of an associated parking space. The microcontroller initiates the timer for a prepaid parking interval upon receiving a signal from the payment acceptance mechanism. A vehicle detector is coupled with the microcontroller for detecting the presence or absence of a vehicle in the associated parking space. A communications modem is coupled with the microcontroller. The microcontroller initiates a call notifying authorities as to a parking violation upon the vehicle detector signalling to the microcontroller the presence of a vehicle in the associated parking space after the expiration of the prepaid parking interval.

12 Claims, 2 Drawing Sheets

PARKING METER

FIELD OF THE INVENTION

The present invention relates to a parking meter and, more particularly, a parking meter that includes a means for detecting the presence or absence of a vehicle.

BACKGROUND OF THE INVENTION

Many municipalities have a massive capital investment in a parking meter infrastructure that includes thousands of parking spaces with a parking meter associated with each parking space. These municipalities are continuously looking for new ways to maximize the return realized by their parking meter infrastructure.

U.S. Pat. No. 4,823,928 which issued to POM Incorporated in 1989, describes an electronic parking meter system that resets the timing circuit to zero when a vehicle is no longer detected in the associated parking space. This feature enables a municipality to derive greater revenues, for there is never time left on the meter when a subsequent vehicle pulls into the same parking space. Due to a continual turn over of vehicles in high traffic areas, the revenues derived using the POM Incorporated system with an automatic reset exceed the hourly charge x the number of hours of operation. The POM Incorporated parking meter is placed in an operational mode when a coin is deposited. When placed in the operational mode, a sonar range finder is turned on which detects the presence or absence of a vehicle in the associated parking space. Notwithstanding time remaining on the meter, the sonar range finder provides a signal to a microprocessor controller when the vehicle is no longer in the associated parking space, and the microprocessor controller resets the timer.

While the POM Incorporated parking meter assists in maximizing parking meter revenues, it does not address an area in which an even greater loss of revenues occurs; that being from parking meter violations. In order to catch parking meter violations, parking meter attendants and parking by-law enforcement officers patrol the streets. Typically, a comparatively few number of enforcement officers are charged with responsibility for a huge number of parking meters, so enforcement is random, at best.

SUMMARY OF THE INVENTION

What is required is a parking meter that will assist in recovering revenues from parking meter violations.

According to the present invention there is provided a parking meter which includes a microcontroller and a timer coupled with the microcontroller. Payment acceptance means is coupled with the microcontroller for accepting payment for use of an associated parking space. The microcontroller initiates the timer for a prepaid parking interval upon receiving a signal from the payment acceptance means. Vehicle detection means is coupled with the microcontroller for detecting the presence or absence of a vehicle in the associated parking space. A communications modem is coupled with the microcontroller. The microcontroller initiates a call notifying authorities as to a parking violation upon the vehicle detection means signalling to the microcontroller the presence of a vehicle in the associated parking space after the expiration of the prepaid parking interval.

With the parking meter, as described above, parking authorities are called to parking meter violations. This takes the random aspect away from enforcement.

Although beneficial results may be obtained through the use of the parking meter, as described above, a potential weakness of the above described approach that is also present in the POM Incorporated parking meter is that the monitoring of the meter is initiated by a coin being deposited in the meter. If a parking violator parks in a parking space without depositing a coin the system remains dormant. Even more beneficial results may, therefore, be obtained when the microcontroller initiates the timer for a predetermined standby interval upon receiving a signal from the vehicle detection means that a vehicle is present in the associated parking space. The microcontroller terminates the timing of the standby interval upon receiving a signal from the payment acceptance means. If the parking violator leaves the vehicle without depositing a coin in the parking meter, the microcontroller initiates a call notifying authorities as to a parking violation upon the vehicle detection means signalling to the microcontroller the presence of a vehicle in the associated parking space after the expiration of the standby interval.

Although beneficial results may be obtained through the use of the parking meter, as described above, a potential weakness in summoning the parking authorities to a particular parking meter is that due to a large volume of concurrent calls there may be a time interval before the parking authorities can respond. In that time interval, the parking violator may return to his vehicle and leave the associated parking space. Even more beneficial results may, therefore, be obtained when a camera is coupled with the microprocessor. The camera is focused at the associated parking space. The microprocessor initiates the camera to take an image of a vehicle upon the vehicle detection means signalling to the microprocessor the presence of the vehicle in the associated parking space after the timer has signalled to the microprocessor the expiration of the prepaid parking interval.

With the parking meter, as described above, the parking authorities are able to write a ticket for the parking violation every time they are summoned. Should the vehicle no longer be there, the camera will provide an image of the front of the vehicle including the license number of the vehicle.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
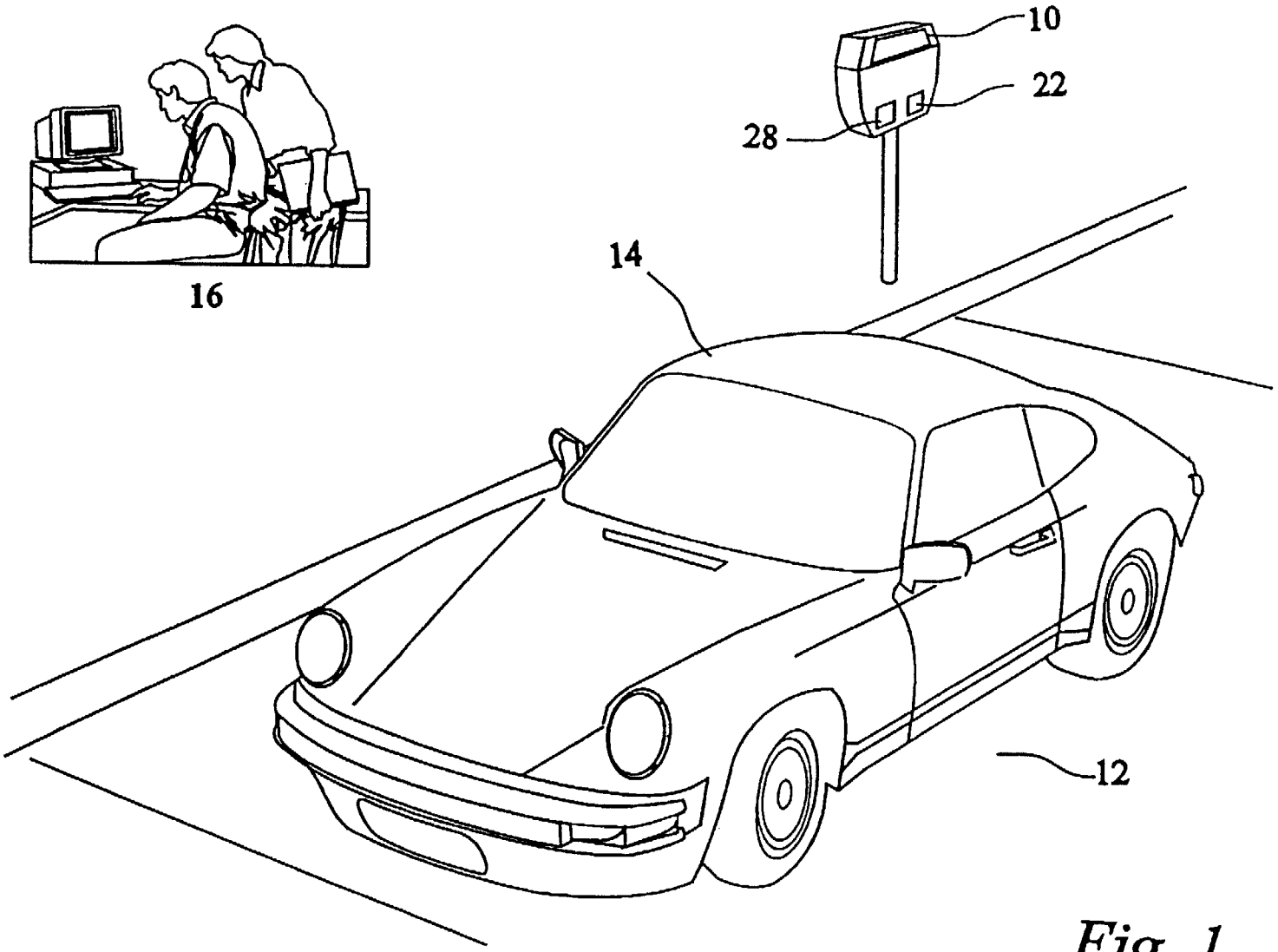
FIG. 1 is a perspective view of a parking meter constructed in accordance with the teachings of the present invention.

The preferred embodiment, a parking meter generally identified by reference numeral 10, will now be described with reference to FIGS. 1 and 2.

Figure 2:
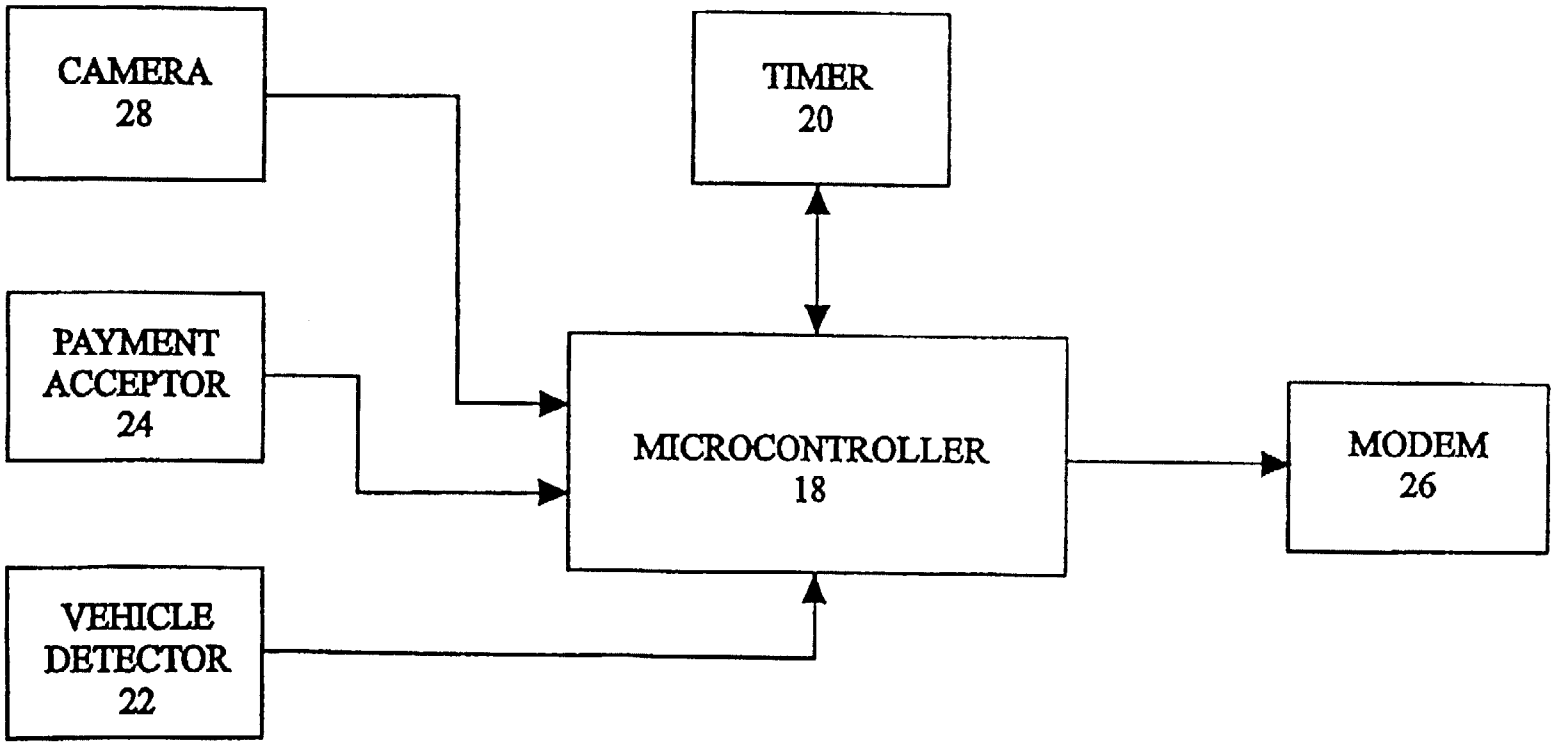
FIG. 2 is a block diagram of the components of the parking meter illustrated in FIG. 1.

Referring to FIG. 1, there is illustrated parking meter 10 and an associated parking space 12. A vehicle 14 is parked in associated parking space 12. Also illustrated is a remote monitoring station 16, the purpose and operation of which will hereinafter be further described. Referring to FIG. 2, the internal components of parking meter 10 include a microcontroller 18. A timer 20 is coupled with and controlled by microcontroller 18. A vehicle detector 22 is coupled with and sends signals to microcontroller 18. Referring to FIG. 1, vehicle detector 22 is focused at associated parking space 12 so that it detects the presence or absence of a vehicle, such as vehicle 14, in associated parking space 12. Referring to FIG. 2, a payment acceptance mechanism 24 is coupled with and sends signals to microcontroller 18. Payment acceptance mechanism 24 can be configured to accept payment by coin, credit card or both for use of associated parking space 12. A communications modem 26 is coupled with and controlled by microcontroller 18. A digital camera 28 is coupled with and controlled by microprocessor 18. Referring to FIG. 1, digital camera 28 is focused at associated parking space 12.

The use and operation of parking meter 10 will now be described with reference to FIGS. 1 and 2. Referring to FIG. 1, the operation of parking meter 10 is initiated by vehicle 14 pulling into associated parking space 12 and its presence being detected by vehicle detector 22. Microcontroller 18 initiates timer 20 for a predetermined standby interval upon receiving a signal from vehicle detector 22 that vehicle 14 is present in associated parking space 12. Should payment be made for use of associated parking space 12 microcontroller 18 will terminate the timing of the standby interval and initiate timer 20 for a prepaid parking interval upon receiving a signal from payment acceptance mechanism 24. A parking violation occurs when the operator of vehicle 14 either fails to make payment or when the prepaid parking interval expires. Microcontroller 18 initiates a call through communications modem 26 notifying parking authorities at monitoring station 16 as to a parking violation upon vehicle detector 22 signalling to microcontroller 18 the presence of vehicle 14 in associated parking space 12 after the expiration of either the standby interval or the prepaid parking interval. Concurrently with initiating a call notifying parking authorities as to the parking violation, microprocessor 18 activates digital camera 28 to take a digital image of vehicle 14. It will be appreciated that there are a number of alternative camera technologies that can be utilized to capture a visual image of the license plate of vehicle 14, such as video, or still photographs. It will also be appreciated that the digital image can be transmitted immediately, or can be stored for recovery at a later date. In future other means of identifying vehicle 14 may be developed. For example, the development of a "smart plate" may permit electronic identification of the vehicle.

The communications link between monitoring station 16 and parking meter 10 can be used for a number of secondary purposes. When parking meter 10 is not in operation a signal can be sent from monitoring station 16 to place microcontroller 18 in a dormant mode. Remote audit reporting can be conducted as required through communication between parking meter 10 and remote monitoring station 16.

In this application the term "credit card" has been used. It is intended that this term encompass the entire spectrum of card form payments, including; debit cards, smart cards, stored value cards, proprietary parking cards, and parking passes.

It will be appreciated by one skilled in that art that there are a variety of payment acceptance mechanisms that can be utilized. It will also be appreciated by one skilled in the art that vehicle detector 22 can operate based upon a variety of alternative detection technologies, such as ultrasonic, infrared, or micro-powered radar.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A parking meter, comprising:

i) a microcontroller;

ii) a timer coupled with the microcontroller;

iii) payment acceptance means coupled with the microcontroller for accepting payment for use of an associated parking space, such that the microcontroller initiates the timer for a prepaid parking interval upon receiving a signal from the payment acceptance means;

iv) vehicle detection means coupled with the microcontroller for detecting the presence or absence of a vehicle in the associated parking space;

v) means for identifying a vehicle parked in the associated parking space, comprising digital camera means coupled with the microcontroller, said camera adapted to be focused at the associated parking space in the area of the parking space where the license plate of a parked vehicle is located, the microcontroller initiating the camera to take an image of a vehicle license plate upon determining the existence of a parking violation; and vi) digital storage means for storing said digital image for subsequent retrieval or transmission.

2. The parking meter of claim 1 further comprising:

vii) telecommunications means coupled with said microcontroller, the microcontroller initiating a call notifying a remote monitoring station upon determining the existence of a parking violation.

3. The parking meter of claim 2 wherein said telecommunications means is adapted to transmit said digital image to said authorities.

4. The parking meter of claim 1 wherein said microcontroller comprises a microprocessor.

5. The parking meter as defined in claim 1 wherein said vehicle detection means comprises an ultrasonic detector.

6. The parking meter as defined in claim 1 wherein said vehicle detection means comprises an infrared detector.

7. The parking meter as defined in claim 1 wherein said vehicle detection means comprises radar.

8. The parking meter as defined in claim 2 wherein said telecommunications means comprises a modem.

9. The parking meter as defined in claim 1, wherein the microcontroller initiates the timer for a predetermined standby interval upon receiving a signal from the vehicle detection means that a vehicle is present in the associated parking space, wherein said microcontroller is adapted to terminate the timing of the standby interval upon receiving a signal from the payment acceptance means, and said microcontroller initiates the camera to take an image of a vehicle license plate after expiry of said standby interval without receiving a signal from said payment acceptance means that a payment has been made.

10. The parking meter as defined in claim 2, wherein the microcontroller initiates the timer for a predetermined standby interval upon receiving a signal from the vehicle detection means that a vehicle is present in the associated parking space, the microcontroller is adapted to terminate the timing of the standby interval upon receiving a signal from the payment acceptance means, and the microcontroller initiates a call to said remote monitoring station as to a parking violation after the expiration of the standby interval without receiving a signal from said payment acceptance means that a payment has been made.

11. The parking meter as defined in claim 1, wherein the microcontroller determines the existence of a parking violation upon the vehicle detection means signalling to the microcontroller the presence of a vehicle in the associated parking space after expiry of said prepaid parking interval.

12. The parking meter as defined in claim 2, wherein the microcontroller determines the existence of a parking violation upon the vehicle detection means signalling to the microcontroller the presence of a vehicle in the associated parking space after expiry of said prepaid parking interval.

* * * * *